US005271113A

United States Patent [19]

White

[11] Patent Number: 5,271,113

[45] Date of Patent: Dec. 21, 1993

[54] ELECTROMECHANICAL AMBULANCE COT CONVERSION KIT

[76] Inventor: Johnny White, 411 Main, Newport, Ark. 72112

[21] Appl. No.: 874,811

[22] Filed: Apr. 28, 1992

[51] Int. Cl.[5] ..... A61G 1/02

[52] U.S. Cl. ..... 5/611; 5/11; 254/126; 254/DIG. 2; 254/9 C; 296/20

[58] Field of Search ..... 5/611, 11; 254/122, 254/126, 9 C, DIG. 2; 296/20

[56] References Cited

U.S. PATENT DOCUMENTS 4,271,545 6/1981 Christian, III ..... 5/616
4,558,847 12/1985 Coates ..... 254/9 C
4,613,122 9/1986 Manabe ..... 254/122
4,984,774 1/1991 Zupancic et al. ..... 254/122
5,022,105 6/1991 Catoe ..... 5/611

*Primary Examiner*—Alexander Grosz
*Attorney, Agent, or Firm*—Ray F. Cox, Jr.

[57] ABSTRACT

The present invention provides for the conversion of a manual-type ambulance cot to electromechanical usage. In a manual-type cot having a wheeled undercarriage, a cot frame, scissor-action collapsible legs and an extensible member associated with the undercarriage so that extension and retraction of the extensible member raises and lowers the cot frame, the improvement of the present invention includes a linear actuator attached to the extensible member and powered by a high energy density gelcel-type battery. Manual lifting of the cot frame is replaced by electromechanical raising and lowering so that lifting injuries may be avoided.

1 Claim, 5 Drawing Sheets

ELECTROMECHANICAL AMBULANCE COT CONVERSION KIT

BACKGROUND OF THE INVENTION

The present invention relates to a manual ambulance cot used in the emergency medical services field. More specifically, the present invention relates to a 12 volt conversion kit which can be added to a manual cot which will cause the cot to be raised or lowered with the press of a rocker switch.

PRIOR ART

Lifting injuries encountered by ambulance personnel, such as emergency medical technicians, paramedics, police officers, firemen and attendants, are very common due to lifting patients lying on a manual ambulance cot. No device is know, however, for converting a manual cot to electromechanical to prevent these lifting injuries.

SUMMARY OF THE INVENTION

The principal object of the present invention is to provide a device for use in the ambulance service industry that is safe for the user.

It also is an object of the present invention to provide such a device which is of simple, inexpensive construction.

Another object is to provide such a device in light weight form that can be assembled quickly and easily by a user or manufacturer.

A further object is to provide such a device which will decrease stress, muscle strain and back injuries to the emergency medical technicians, paramedics or attendants using it.

The foregoing objects can be accomplished by providing an electromechanical ambulance cot conversion kit to be attached to the framework of a manual-type cot. The manual-type cot in common use today is characterized by a frame with suitable supports for a mattress, a wheeled undercarriage, and collapsible legs for supporting the mattress frame on the wheeled undercarriage. The collapsible legs allow the cot to be used in an up position or in a down position for easy storage or transportation. In the prior art manual-type cot the paramedic or emergency medical technician must manually lift the cot into the up position at the risk of sustaining a lifting injury. The collapsing legs of the prior art manual-type cot are of a cross or scissor-like construction which are pivoted together and secured by their lower ends to the wheeled undercarriage. The wheeled undercarriage normally employs an extension member attached to the ends of one of the cross members of the collapsible legs. By extending or retracting this extensible member the pivoted collapsible legs act to either raise or lower the cot. The present invention contemplates the use of a linear actuator powered by a high energy density gelcel-type battery to operate the extensible member of the wheeled undercarriage in order to raise or lower the cot by electromechanical means rather than by human muscle power. In a paticular embodiment of the present invention the linear actuator, battery and associated electrical and mechanical hardware would be in a kit form for retrofit to an existing manual-type cot.

DETAILED DESCRIPTION

Figure 1:
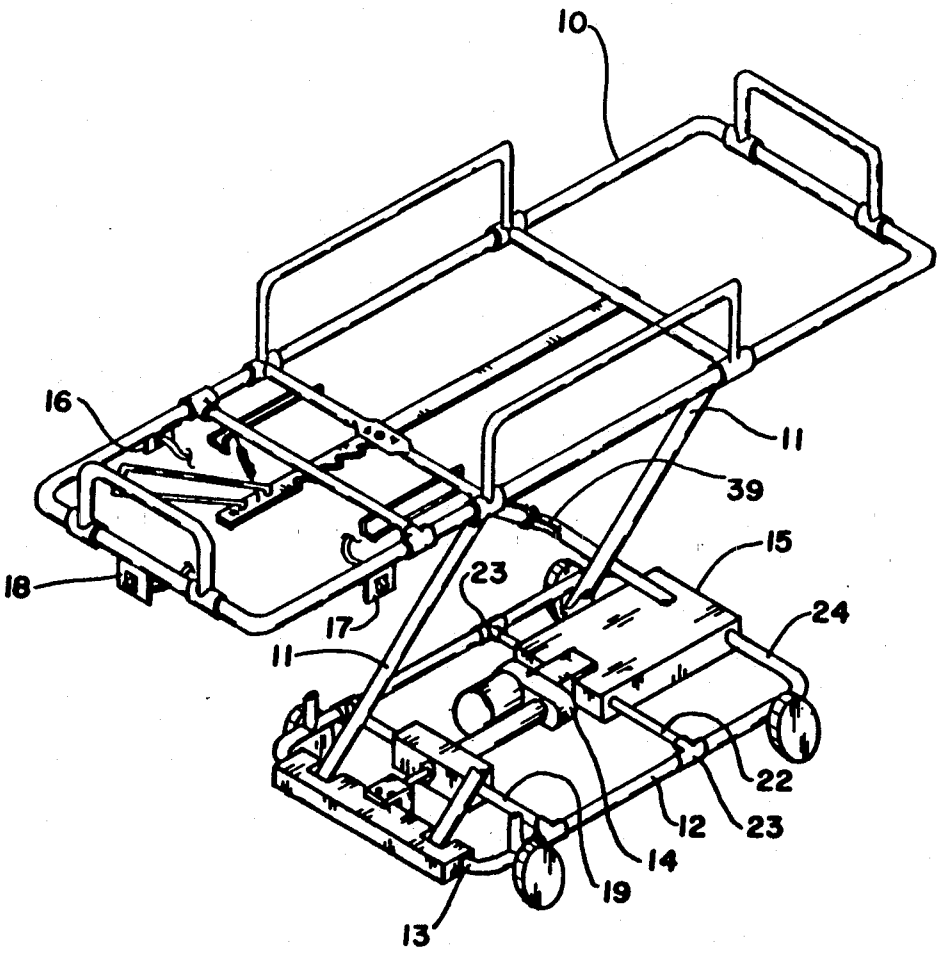
FIG. 1 is a perspective view of the present invention installed on a typical manual-type cot.

With reference to FIG. 1, a typical manual-type cot is shown with the necessary modifications to convert it to an electromechanical cot as set forth in the present invention. The cot includes a cot frame 10 mounted on pivoted scissor-action legs 11. The legs 11 are connected to a wheeled undercarriage 12. An extensible member 13 is pivotally attached to the legs 11 such that movement of the extensible member 13 as its extends and retracts relative to the undercarriage 12 causes the cot frame 10 to be raised or lowered through the scissoring action of the legs 11. The description to this point is for the manual-type prior art cot. The modification to convert the manual-type cot to an electromechanical cot of the present invention includes a linear actuator 14, a high energy density gelcel battery 30 housed in a battery box 15, a pair of double pole, double throw, momentary rocker switches 16, 17 and a recharging plug 18.

Figure 2:
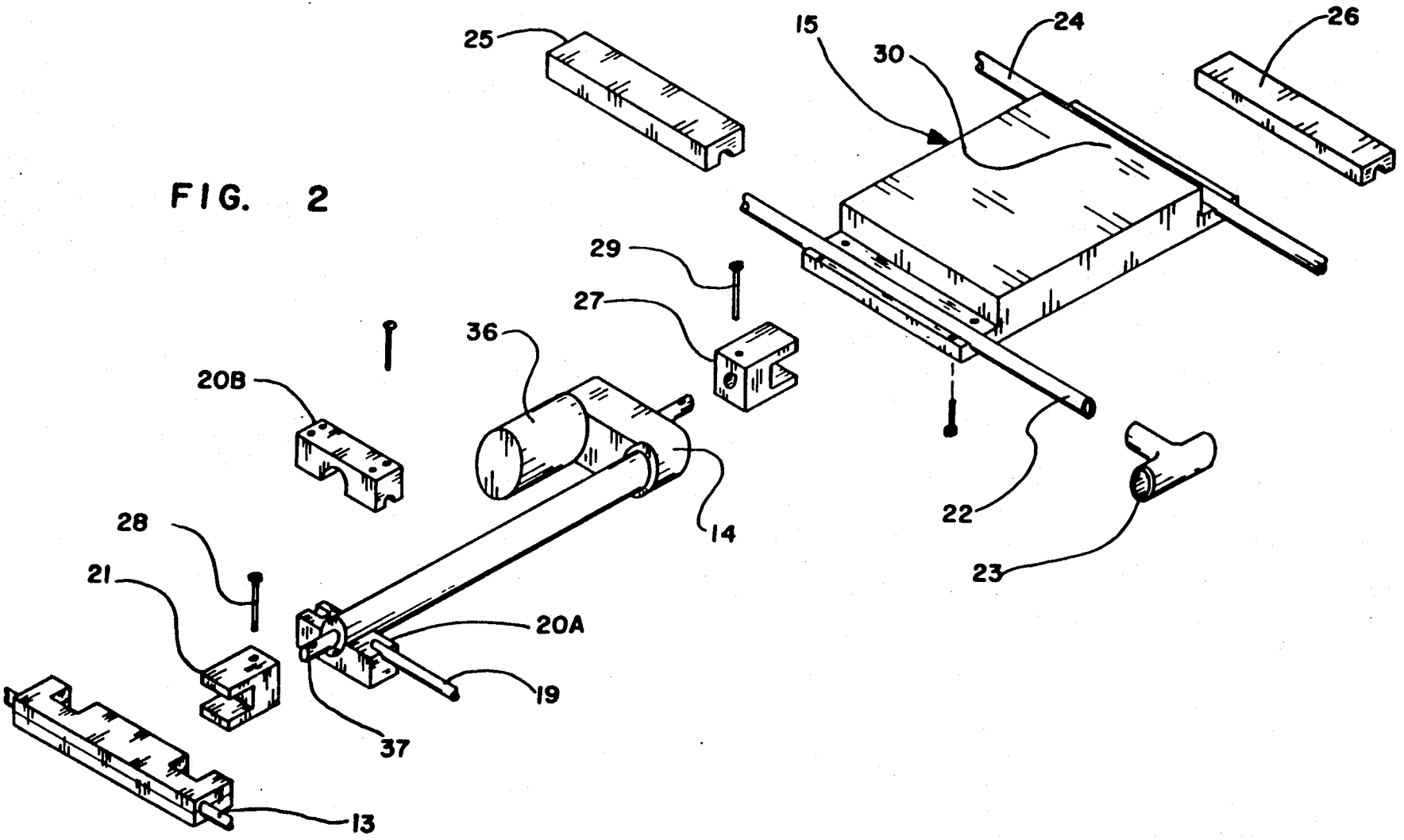
FIG. 2 is an exploded top perspective of a portion of the present invention showing the linear actuator, battery and mechanical components.

The mechanical modifications may be described with reference to FIG. 2. In the prior art cot a front tube 19 spans the width of the undercarriage 12 and is rigidly affixed thereto. The front tube 19 provides a point of attachment for the linear actuator 14 to the undercarriage 12. The front tube 19 is cut and approximately 3 inches removed from its center so blocks 20A and 20B can be installed for support of the linear actuator 14. A connector yoke 21 is connected to the extensible member 13. Additional support for the linear actuator 14 and the battery box 15 is provided by the installation of a tube 22 with connector T's 23 so as to affix the tube 22 between the sides of the undercarriage 12. The battery box 15 is attached to the tube 22 and the rear tube 24 of the undercarriage 12 by battery blocks 25,26 which attach the battery box 15 to the tube 22 and the rear tube 24 respectively. Connector yoke 27 is connected to the battery block 25 in order to provide support to the rear of the linear actuator 14. Connector pins 28, 29 provide for the actual connection of the linear actuator 14 to the connector yokes 21 and 27, respectively. The battery 30 is placed within the battery box 15. The linear actuator 14 includes a 12 volt direct current motor 36 driving an extension shaft 37. The extension shaft 37 requires a stroke of approximately 8 inches. The linear actuator 14 should be rated at approximately 1000 pounds. By way of example, the Model 10 Series D12-20B5-08 linear actuator manufactured by Warner Electric has been found to give satisfactory performance. This model has the further advantages of lightweight construction and corrosion protection. Since it is a ball bearing screw drive system with overload protection, it has the load capacity and safety features preferred for this application. In operation the extension and retraction of the extension shaft 37 by the motor 36 acts on the extensible member 13 to effect the raising and lowering of the cot.

Figure 3:
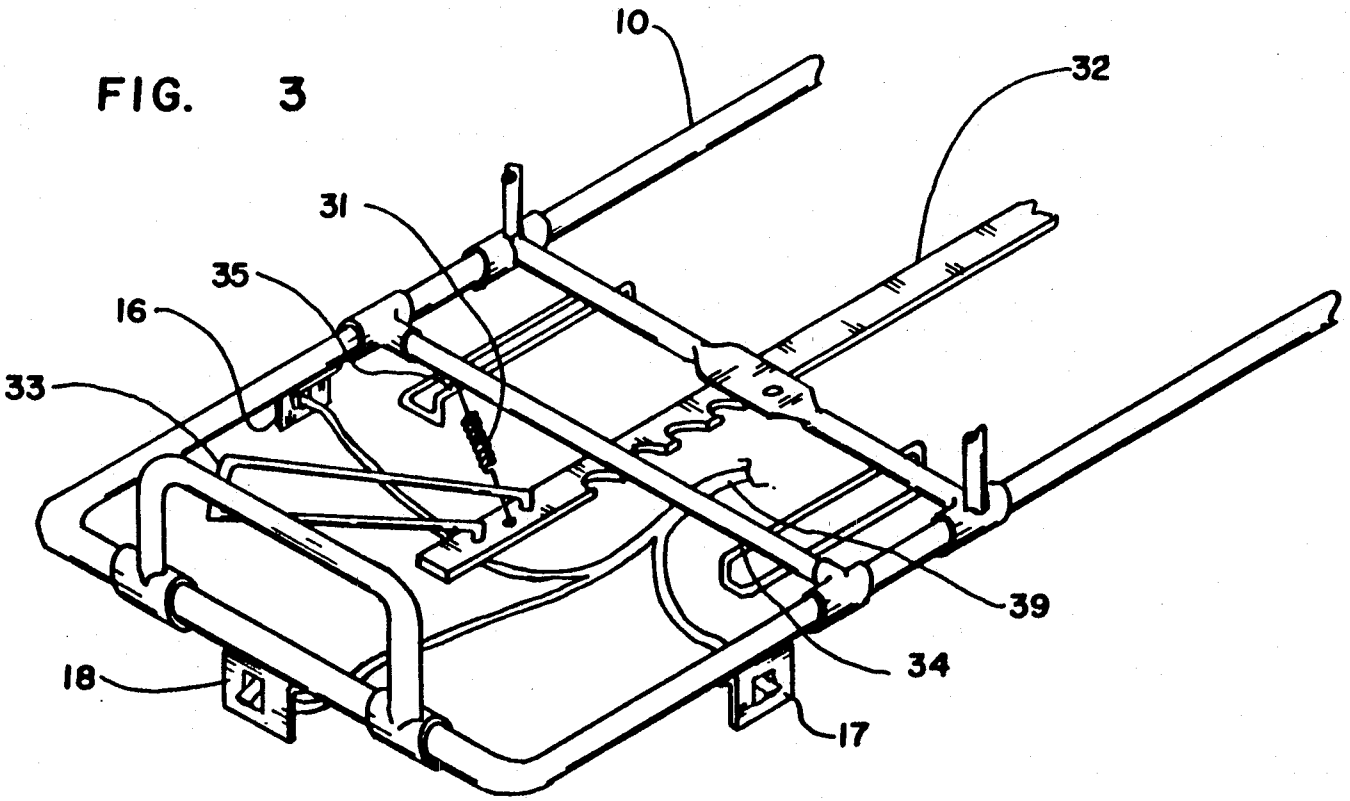
FIG. 3 is a fragmentary top perspective view of a typical manual-type cot showing the modifications made for the present invention including the wiring harness, switches, switch holders and charging plug.
Figure 4:
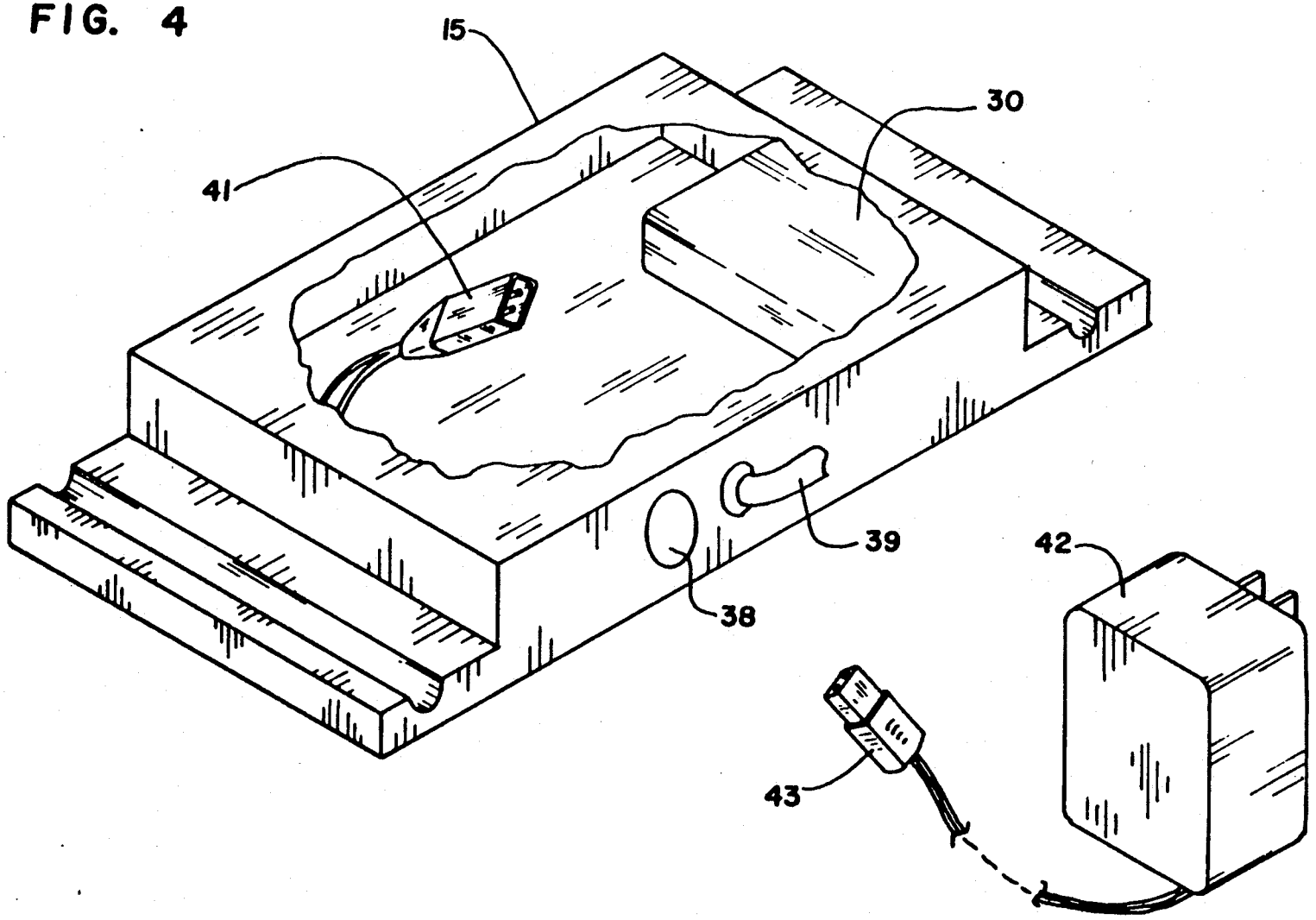
FIG. 4 is a top view of the battery box and fuse holder.
Figure 5:
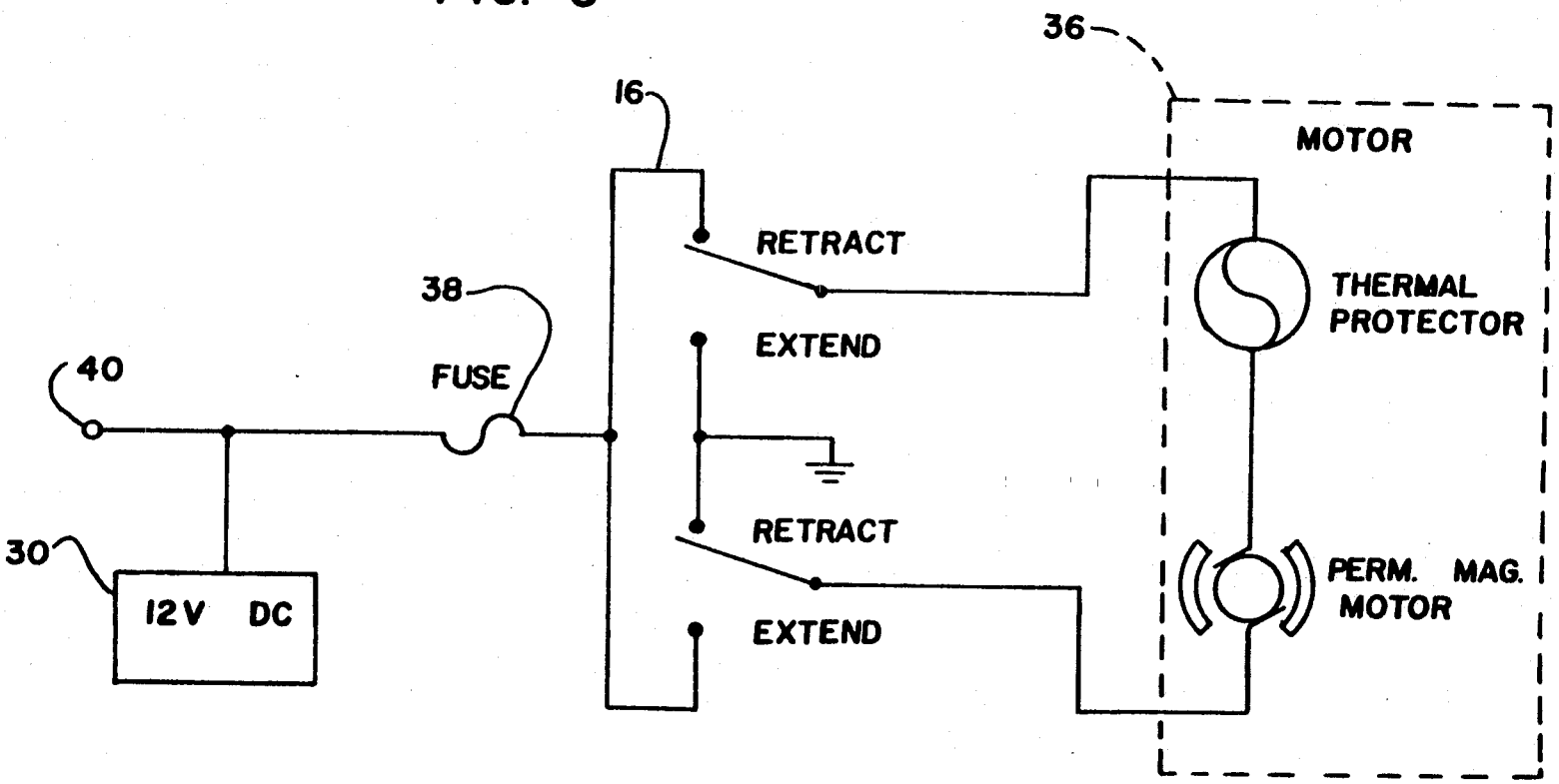
FIG. 5 is a wiring diagram.

Referring to FIG. 3, which shows a portion of the cot frame 10, the installation of the switches 16, 17 and the charging plug 18 may be seen. Switches 16, 17 are installed on each side of the cot frame 10 for easy access by the user. Likewise the charging plug 18 is installed on the end of the cot frame 10 for easy access. The charging plug 18 is in the preferred embodiment a quick disconnect cigarette lighter type of plug for compatibility with the types of direct current plugs available to emergency medical technicians. The charging plug 18 is connected through the wiring harness 39 to the battery 30 at the point 40 on FIG. 5. An alternative charging mechanism using 110 volt alternating current is made available through a connector 41 directlyt wired to the battery 30 at the point 40 shown on FIG. 5. A 110 volt alternating current charger 42 is wired to a complmentary connector 43 which mates with the connector 41. In use the charger 42 is plugged into a standard wall outlet and the connectors 41, 43 connected. The charger 42 is removable and would be used only when the cot is available for recharging in proximity to standard 110 volt alternating current wall outlets. The switches 16, 17 are of double pole, double throw momentary rocker-type switches. The invention may be operated from either side of the cot. Momentary pressure on either switch 16, 17 will cause the cot frame 10 to be raised or lower to the desired height. The wiring connection of the switches 16, 17 and the charging plug 18 are described with reference to FIG. 3,4 and 5. The battery 30 is connected through a fuse 38 and the switches 16, 17 to the motor 36 of the linear actuator 14. The switches 16, 17 are wired in parallel so the user may actuate the device from either switch. The various electrical components are connected through a wiring harness 39. The battery 30 is a 12 volt sealed gelcel-type. It should be rated at at least 18 amperes although 30 amperes is preferred for enhancing the amount of usage between recharges.

The typical manual-type cot is provided with a mechanism to the lock the cot into various predetermined heights. The basic mechanism may be understood with reference to FIG. 3. A saw-toothed locking bar 3 locks the cot into various heights. The saw-toothed locking bar 32 is operated by the manual locking handle 33. The saw-toothed locking bar 32 is, in the manual mode, held into a locking position by a spring 31 which is attached to the manual locking handle 33 and to a point on the right side of the cot frame 34. The cot may be restored to manual usage by changing the spring 31 to a point on the left side of the cot frame 35 and removing pin 28. Conversion to manual usage may be required in the event of a mechanical malfunction of the present invention or to unanticipated discharge of the battery 30.

These features of the present invention as described above increase the safety of the manual-type cot for users by reducing or eliminating the incidence of lifting injuries. The smoother operation of the electromechanical action should also be more comfortable and safer for the patient.

The present invention has been described with reference to a preferred embodiment. Persons skilled in the art will recognize that various modifications may be made to the invention as described without departing from the full scope of the invention as set forth in the appended claims.

What is claimed is:

1. In an ambulance cot of the type having a wheeled undercarriage with a front tube and a rear tube spanning the width of the undercarriage, a cot frame, scissor-action collapsible legs attached to the cot frame and the undercarriage, and an extensible member associated with the undercarriage and pivotally attached to the legs so that extension and retraction of the extensible member raises and lowers the cot frame through the scissoring action of the legs, the improvement comprising:

(a) a linear actuator having a front end, a rear end, and an extension shaft driven by a direct current motor, (b) means for mechanically connecting said linear actuator between the extensible member and the undercarriage, comprising a block affixed to said front tube and to said front end of said linear actuator, a first connector yoke connecting said extension shaft to said extensible member, an additional tube spanning said width of said undercarriage between said front tube and said rear tube and rigidly affixed to said undercarriage, a battery box rigidly affixed to said additional tube and to said rear tube, and a second connector yoke connecting said rear end of said linear actuator to said battery box, (c) a high energy density gelcel battery, (d) means for recharging said battery, (e) means for electrically connecting and disconnecting said battery to said linear actuator, and (f) means for reversibly actuating said linear actuator.

* * * * *